US008998045B2

(12) United States Patent
Cartwright

(10) Patent No.: US 8,998,045 B2
(45) Date of Patent: Apr. 7, 2015

(54) ERGONOMIC STRAPS AND CARRYING ASSEMBLIES EMPLOYING SAME

(75) Inventor: Jill Cartwright, Jamaica Plain, MA (US)

(73) Assignee: Daddyscrubs, LLC, Torrance, CA (US)

( * ) Notice: Subject to any disclaimer, the term of this patent is extended or adjusted under 35 U.S.C. 154(b) by 35 days.

(21) Appl. No.: 12/598,838

(22) Filed: Nov. 4, 2009

(65) Prior Publication Data

US 2011/0036878 A1 Feb. 17, 2011

(51) Int. Cl.
*A45F 3/12* (2006.01)
*A45F 3/02* (2006.01)

(52) U.S. Cl.
CPC .... *A45F 3/12* (2013.01); *A45F 3/02* (2013.01)

(58) Field of Classification Search
USPC ..... 224/643, 651, 175, 264, 578, 607, 610, 224/257, 258
See application file for complete search history.

(56) References Cited

U.S. PATENT DOCUMENTS

| | | | | |
|---|---|---|---|---|
| 4,724,987 | A | 2/1988 | Maheu | |
| D306,655 | S | 3/1990 | Schlegel Liebert | |
| 5,203,482 | A * | 4/1993 | Puff | 224/257 |
| 6,145,131 | A * | 11/2000 | Huff | 2/207 |
| 2005/0205620 | A1 * | 9/2005 | Yagisawa | 224/159 |
| 2007/0007314 | A1 | 1/2007 | Lin | |

OTHER PUBLICATIONS

PCT Search Report PCT/US 08/75017, Nov. 18, 2008.

* cited by examiner

*Primary Examiner* — Brian D Nash
*Assistant Examiner* — Corey Skurdal
(74) *Attorney, Agent, or Firm* — Tutunjian & Bitetto, P.C.

(57) ABSTRACT

Ergonomic straps for carrying assemblies, and carrying assemblies that include such ergonomic straps, are disclosed.

14 Claims, 7 Drawing Sheets

ERGONOMIC STRAPS AND CARRYING ASSEMBLIES EMPLOYING SAME

CROSS REFERENCE TO RELATED APPLICATIONS

This patent application claims priority benefits under 35 USC §119 from pending International Application No. PCT/US2008/075017 filed on Sep. 2, 2008, which in turn claims priority benefits from U.S. patent application No. 60/969,643 filed on Sep. 2, 2007, which applications are incorporated herein by reference.

FIELD OF THE INVENTION

The present disclosure is directed to ergonomic straps for carrying assemblies, including shoulder bags, totes, carrying cases, diaper bags, and the like, and for comfortably supporting devices, including instruments, cameras, and the like.

BACKGROUND OF THE INVENTION

Assemblies for carrying personal articles are ubiquitous devices having utility in a wide variety of circumstances. More specifically, bags having shoulder straps may be used for transporting personal items, baby articles, electronic devices, sports equipment, and many other types of articles. Examples of known assemblies having shoulder-engaging straps include those devices disclosed in U.S. Pat. No. 7,160,028 issued to Linday, U.S. Pat. No. 7,004,363 issued to Fenton, U.S. Pat. No. 5,988,474 issued to Smith, U.S. Pat. No. 5,909,833 issued to Smith, and U.S. Pat. No. 4,119,127 issued to Klug. Although desirable results have been achieved, such designs may cause discomfort, fatigue, or other undesirable effects to the wearer. Therefore, assemblies that mitigate such undesirable effects would have considerable utility.

SUMMARY

The present disclosure is directed to ergonomic straps for carrying assemblies, including shoulder bags, totes, carrying cases, diaper bags, and the like, and for comfortably supporting devices, including instruments, cameras, and the like. Embodiments of assemblies and methods in accordance with the teachings of the present disclosure may advantageously mitigate discomfort, fatigue, or other undesirable effects that may be experienced by a wearer of conventional carrying straps.

BRIEF DESCRIPTION OF THE DRAWINGS

Embodiments of the present disclosure are described in detail below with reference to the following drawings.

DETAILED DESCRIPTION

The present disclosure is directed to ergonomic straps for carrying assemblies. Many specific details of certain embodiments in accordance with the present disclosure are set forth in the following description and in FIGS. 1-13 to provide a thorough understanding of such embodiments. One skilled in the art, however, will understand that the present invention may have additional embodiments, or that the invention may be practiced without several of the details described in the following description.

Generally, embodiments of straps in accordance with the teachings of the present disclosure may include a relatively-widened intermediate portion. The intermediate portion may be flexibly adjusted between an expanded position and a condensed position. In operation, the intermediate portion in the expanded position may advantageously engage both the top and lateral surface portions of a shoulder of a wearer, providing an improved weight distribution in comparison with conventional devices. Embodiments of straps in accordance with the present disclosure may be coupled to containment members, instruments, cameras, or any other suitable devices. Therefore, in the following discussion, a description of a strap coupled to a containment member may apply equally to a strap coupled to an instrument or other device to be carried (and vice versa) unless otherwise expressly stated.

Figure 1:
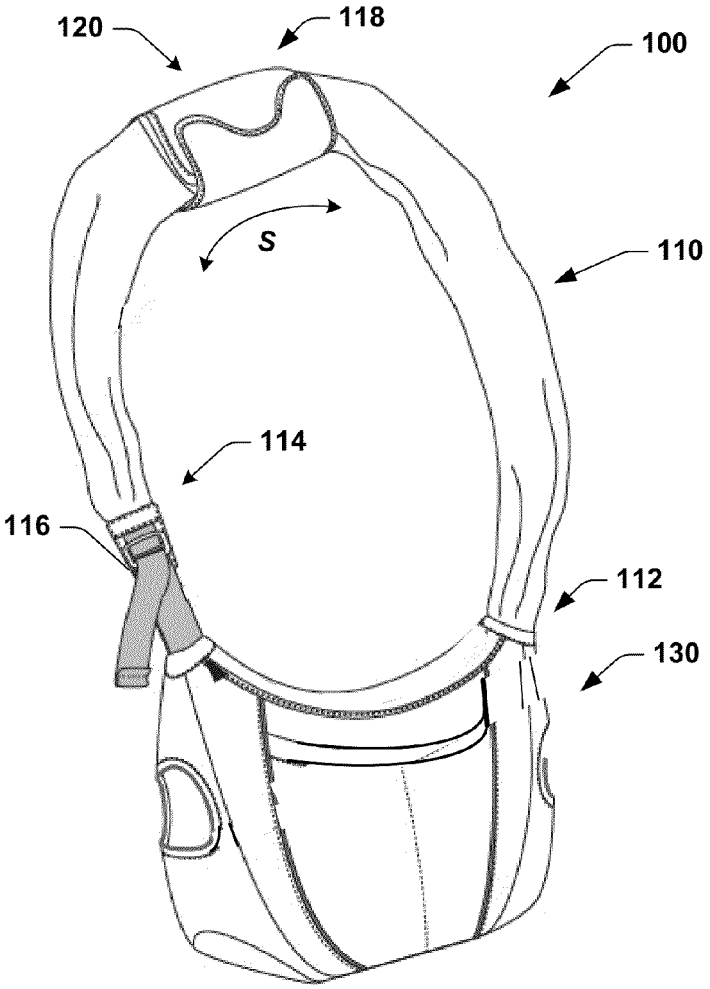
FIG. 1 is an isometric view of a carrying assembly having a strap in a first position in accordance with an embodiment of the present disclosure.

FIG. 1 is an isometric view of a carrying assembly 100 in accordance with an embodiment of the present disclosure. In this embodiment, the carrying assembly 100 includes a strap 110 having a first end portion 112 fixedly coupled (e.g. sewn, etc.) to a containment member 130, and a second end portion 114 adjustably coupled to the containment member 130 by an adjustment mechanism 116. A cinch member 120 is slideably coupled to the strap 110 and is moveable along the strap 110 (as indicated by arrow S) between the first and second end portions 112, 114. In a first position 118 shown in FIG. 1, the cinch member 120 is positioned at an approximately center portion of the strap 110.

Figure 2:
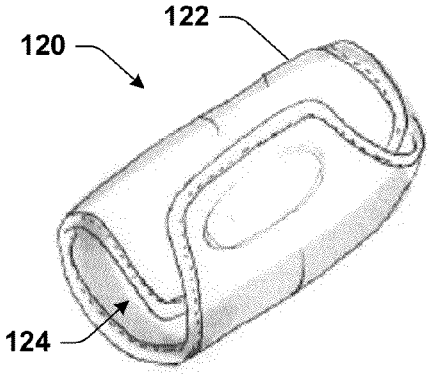
FIG. 2 is an enlarged view of a cinch member of the strap of the carrying assembly of FIG. 1 in accordance with an embodiment of the present disclosure.

As best shown in FIG. 2, the cinch member 120 may have a generally sleeve-shaped outer portion 122 that surrounds a slide passage 124 configured to slideably receive the strap 110. In some embodiments, the cinch member 120 may have a generally tubular shape that enables the cinch member 120 to slide along the strap 110. In various alternate embodiments, the slide passage 124 of the cinch member 120 may have a circular, rectangular, elliptical, trapezoidal, irregular, or any other suitable cross-sectional shape. In some embodiments, the cinch member 120 may be removable from the strap 110.

Figure 3:
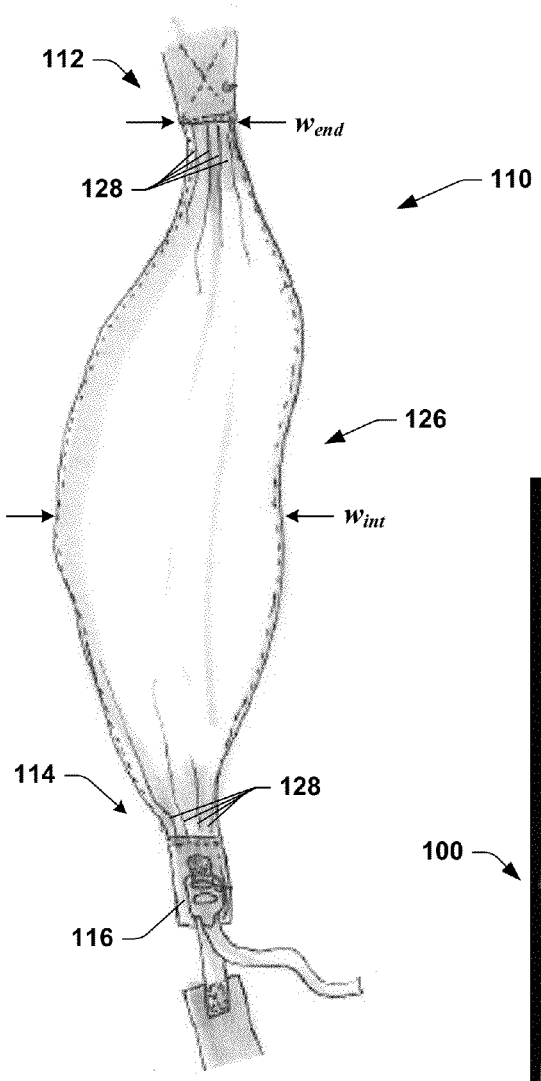
FIG. 3 is an enlarged elevational view of the strap of the carrying assembly of FIG. 1 in accordance with another embodiment of the present disclosure.

FIG. 3 is an enlarged elevational view of the strap 110 of the carrying assembly 100 of FIG. 1. In this embodiment, the strap 110 includes a relatively-wider intermediate portion 126 disposed between relatively-narrower first and second end portions 112, 114. In some embodiments, the intermediate portion 126 includes a plurality of longitudinally-extending folds (or pleats) 128 proximate each of the first and second end portions 112, 114 that taper or narrow the intermediate portion 126 down to a width of the first and second end portions 112, 114. The intermediate portion 126 may be formed of a flexible material that enables the intermediate portion 126 to be captured by the cinch member 120 into a condensed, relatively smaller configuration, and with the cinch member 120 removed or relocated from the intermediate portion 126, the intermediate portion 126 may be expanded into its fully-deployed position having a width $w_{int}$ as shown in FIG. 3.

It will be appreciated that the intermediate portion 126 may have a width $w_{int}$ that is several times wider than that of a width $w_{end}$ of at least one of the first and second end portions 112, 114. For example, in some particular embodiments, the width $w_{int}$ of the intermediate portion 126 may be approximately twice the width $w_{end}$ of at least one of the first and second end portions 112, 114. In other particular embodiments, the width $w_{int}$ of the intermediate portion 126 may be within a range of approximately twice and approximately ten times the width $w_{end}$ of at least one of the first and second end portions 112, 114. In some embodiments, the width $w_{int}$ of the intermediate portion 126 may be within a range of approximately four to approximately six times the width $w_{end}$ of at least one of the first and second end portions 112, 114. In further embodiments, the width $w_{int}$ of the intermediate portion 126 may be greater than approximately ten times the width $w_{end}$ of at least one of the first and second end portions 112, 114.

In some embodiments, the cinch member 120 is slideably coupled to the intermediate portion 126 and moveable between a release position proximate at least one of the first or second end portions 112, 114 to enable the intermediate portion 126 to be actuated to an expanded position, and a cinched position such that the cinch member 120 condenses the intermediate portion 126 into a condensed position. More specifically, in some implementations, the cinch member 120 may be configured to condense the intermediate portion 126 such that a condensed width of the intermediate portion 126 is approximately equal to a width of the first and second end portions 112, 114.

With continued reference to FIG. 3, in some embodiments, the strap 110 may be a stretchable strap, and may be fabricated from (or fabricated to include) a stretchable material. For example, in some embodiments, the strap 110 may preferably be fabricated using a stretchable material, including natural or synthetic materials, such as a stretchable polymeric (or elastomeric) material. More particularly, in some embodiments, the strap 110 may include (or be formed of) one or more of a polyester material, a polyethylene material (e.g. a Very Low Density Polyethylene (VLDPE)), a polyurethane material, a polyamide material (e.g. nylon), a "spandex" (or elastane) material (e.g. Lycra®), or any suitable combinations or blends of such materials. For example, in a presently-preferred embodiment, the intermediate portion 126 of the strap 110 is formed of a blend of nylon (approximately 91%) and Lycra® (approximately 9%). In some particular embodiments, the desired material characteristics (e.g. stretchability, flexibility, strength, etc.) of the strap 110 may be achieved by forming the intermediate portion 126 of a nylon/spandex blend having relative percentages within a range of approximately 80-99% nylon and approximately 20-1% spandex (e.g. Lycra®). Of course, in further embodiments, blends having other relative percentages of nylon and spandex may be employed, or blends having materials other than nylon and spandex may be employed. In various particular embodiments, the strap 110 may be formed of one or more stretchable materials commercially-available from Hana Corporation of Suwon-si Kyunggi, South Korea, or Texever, Inc. of Seoul, South Korea.

Figure 4:
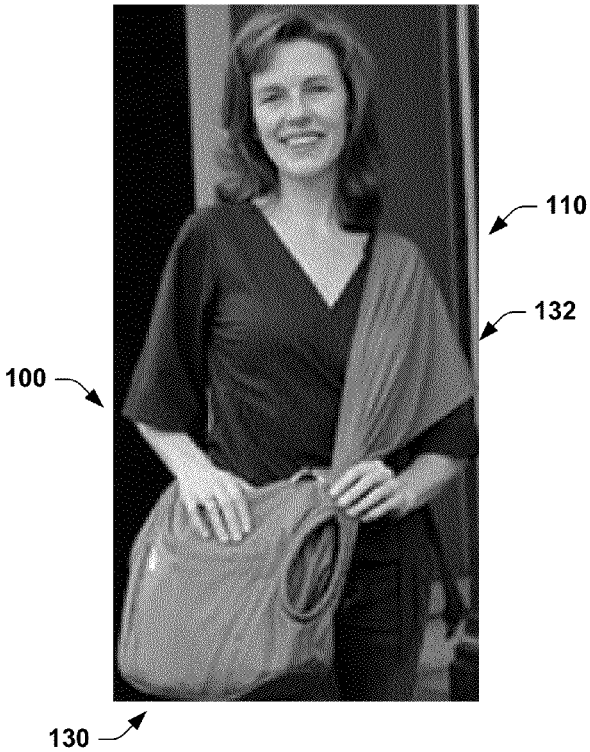
FIG. 4 is an isometric view of the carrying assembly of FIG. 1 having the strap in a second position and engaged on a shoulder of a wearer in accordance with another embodiment of the present disclosure.

FIG. 4 is an isometric view of the carrying assembly 100 of FIG. 1 engaged over a shoulder of a wearer in accordance with another embodiment of the present disclosure. In this embodiment, the strap 110 is deployed in a second (or expanded) position 132. More specifically, in the second position 132, the cinch member 120 (not visible in FIG. 4) is relocated from the intermediate portion 126 of the strap 110 (e.g. by sliding the cinch member 120 to a position proximate an end portion of the strap 110, or by removing the cinch member 120) so that the strap 110 may be expanded into its fully-deployed width $w_{int}$ over the shoulder of the wearer.

As shown in FIG. 4, with the intermediate portion 126 of the strap 110 expanded into a partially or fully-deployed position (e.g. the second position 132), the weight of any articles or devices contained within the containment member 130 that must be borne by the wearer is distributed over a broader area of the wearer's shoulder. In addition, for those embodiments wherein the strap 110 is formed of a stretchable material, the strap 110 may stretch over the wearer's shoulder. Such a stretchable strap 110 may further improve the weight distribution of the carrying assembly 100 over the shoulder of the wearer, reducing and smoothing out pressure points and increasing the overall comfort and satisfaction of the wearer.

More specifically, in some implementations, the strap 110 is worn diagonally across the wearer's body and distributes the weigh of the containment assembly 100 (or other instrument or device being carried using the strap 110) over the top and side (or lateral surface) of the wearer's shoulder (FIG. 4). In this way, the strap 110 may advantageously spread the weight of the object(s) being borne by the wearer across a greater portion of the wearer's body, better enabling the wearer to stand upright with both shoulders even, instead of being pulled to one side by the weight as typically happens when a convention strap (e.g. of a conventional purse) is used or worn on a wearer's shoulder.

In addition, by spreading the weight of the articles being borne over the top and side of the wearer's shoulder, embodiments of the strap in accordance with the present disclosure may reduce the risk of neck strain, shoulder strain, shoulder dislocation, scoliosis, or other spinal strain or misalignment. Also, strap embodiments in accordance with the present disclosure may be worn on both the right and left shoulder. Since many conventional single-strap messenger bags and diaper bags are configured to be worn over only a single shoulder (either left or right), embodiments of straps in accordance with the present disclosure may provide improved versatility and may enable a wearer to avoid excessive strain or fatigue.

Figure 5:
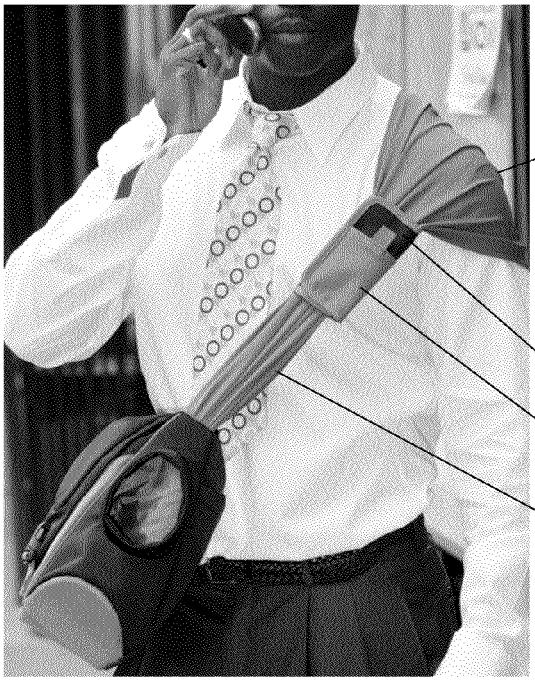
FIG. 5 is an isometric view of a carrying assembly having a strap in a third position and engaged on a shoulder of a wearer in accordance with a further embodiment of the present disclosure.

It will be appreciated that the position of the cinch member 120 on the strap 110 is not limited to the configurations described above. For example, FIG. 5 is an isometric view of a carrying assembly 200 engaged on a shoulder of a wearer in accordance with another embodiment of the present disclosure. In this embodiment, the carrying assembly 200 includes a strap 210 coupled to a containment member 230, and a cinch member 220 slideably disposed on the strap 210. In some embodiments, the cinch member 220 includes a pocket 222 suitable for stowage of, for example, a cellular phone, personal data assistant, or other article.

As shown in FIG. 5, the cinch member 220 may be spaced apart from an end portion of the strap 210, and positioned at a non-central location along the strap 210, enabling the strap 210 to be deployed into a third position 232. In the third position 232, a central portion 212 of the strap 210 engaged over the shoulder of the wearer is deployed into a partially-expanded (or fully-expanded) position, while a front-side portion 214 of the strap 210 that extends along a front side of the wearer is gathered and constrained by the cinch member 220 into an unexpanded position. It will be appreciated that the cinch member 220 may be positioned at virtually any desired intermediate position along the length of the strap 210 (i.e. at any location between the ends of the strap 210).

Figure 6:
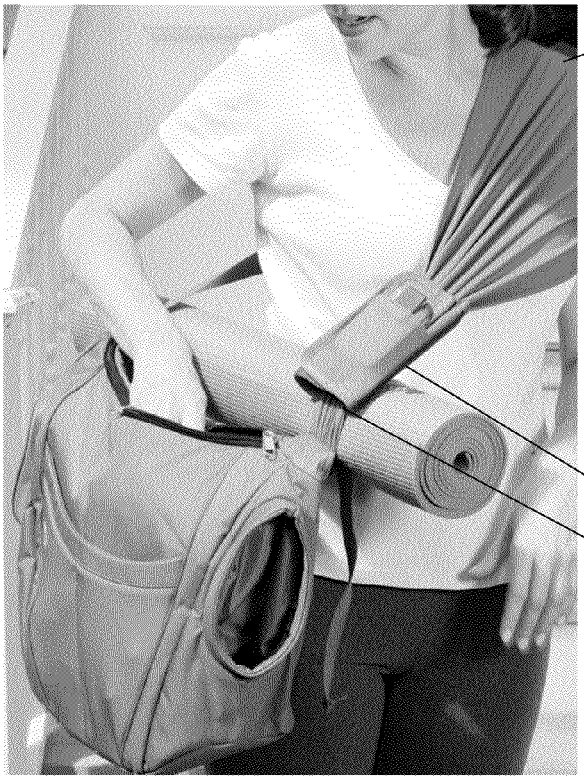
FIG. 6 is an isometric view of a carrying assembly having a strap in a fourth position and engaged on a shoulder of a wearer in accordance with yet another embodiment of the present disclosure.

Similarly, as shown in FIG. 6, the cinch member 220 may be positioned proximate an end portion of the front-side portion 214 of the strap 210, enabling the strap 210 to be deployed into a fourth position 234. In the fourth position 234, the central portion 212 of the strap 210 may be fully deployed in a fully expanded position over the shoulder of the wearer, while the front-side portion 214 of the strap 210 may be deployed in a partially or fully expanded position over the front side of the wearer.

Carrying assemblies having strap members in accordance with the teachings of the present disclosure may provide considerable advantages over the prior art. For example, the substantially increased width of the intermediate portion of the strap may advantageously distribute the weight of the articles within the containment member over a substantially greater area of the shoulder of the wearer in comparison with prior art devices. More specifically, embodiments of strap members in accordance with the present disclosure may distribute the weight over both the top and side (or lateral) surfaces of the wearer's shoulder. Similarly, embodiments having a stretchable strap may further smooth and distribute the weight born by the wearer over the wearer's shoulder.

Embodiments of stretchable strap members in accordance with the present disclosure may provide distinct advantages for persons having particular sensitivities. For example, it is known that nursing mothers may be particularly sensitive to undue pressure on their breasts, and that such pressures may have an undesirable impact upon the breast's milk production. By better smoothing and distributing the weight over the wearer's body, embodiments of straps in accordance with the present disclosure may provide substantially improved comfort to nursing mothers, and may reduce or eliminate undesirable impacts upon milk production in comparison with prior art strap devices.

In addition, embodiments having a cinch member disposed on the strap advantageously enable a user to adjust a position of the strap into a multitude of positions to suit the particular desires or requirements of the wearer, including functional considerations and aesthetic preferences. For example, the adjustability of cinch member may enable some users (e.g. women) to position the cinch member such that the intermediate portion of the strap has a more feminine appearance, while other users (e.g. men) may choose to position the cinch member such that the intermediate portion of the strap has a more masculine appearance. Thus, strap members in accordance with the present disclosure, and carrying assemblies employing such strap members, may advantageously increase the wearer's sense of style and appearance, and overall satisfaction with the strap, in comparison with prior art strap devices.

Figure 7:
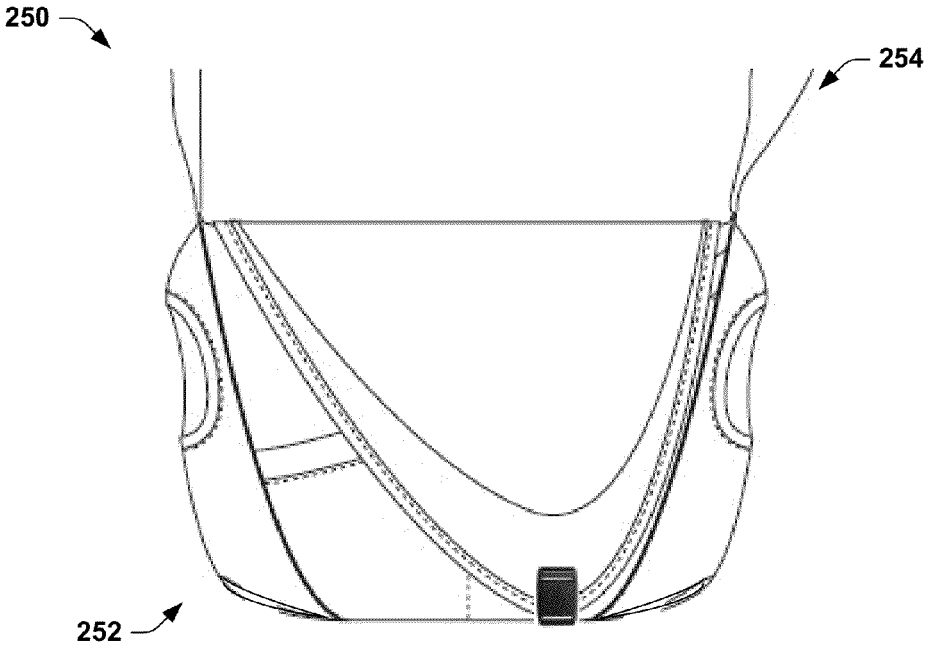
FIG. 7 is a side elevational view of a containment member of the carrying assembly of FIG. 1 in accordance with an embodiment of the present disclosure.
Figure 8:
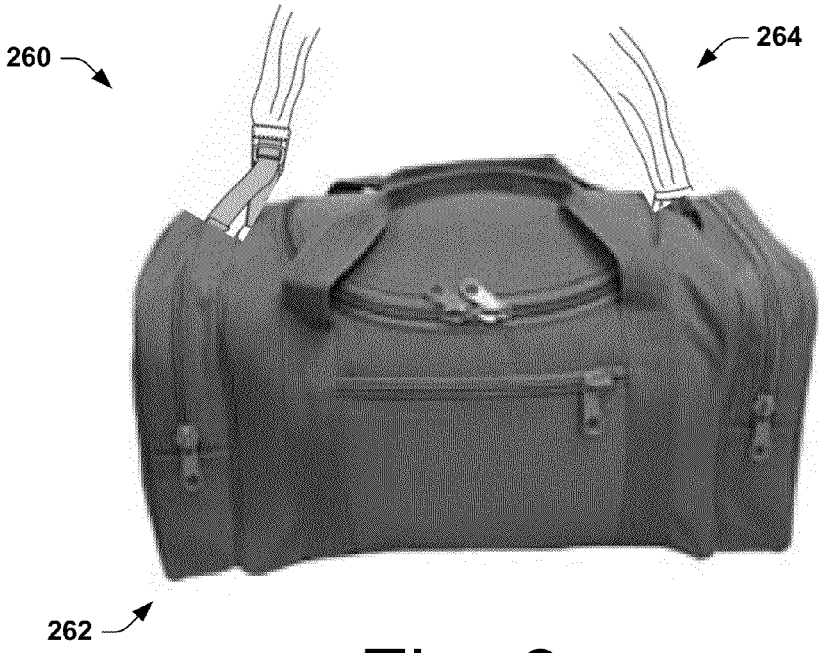
FIG. 8 is a side elevational view of a containment member in accordance with another embodiment of the present disclosure.
Figure 9:
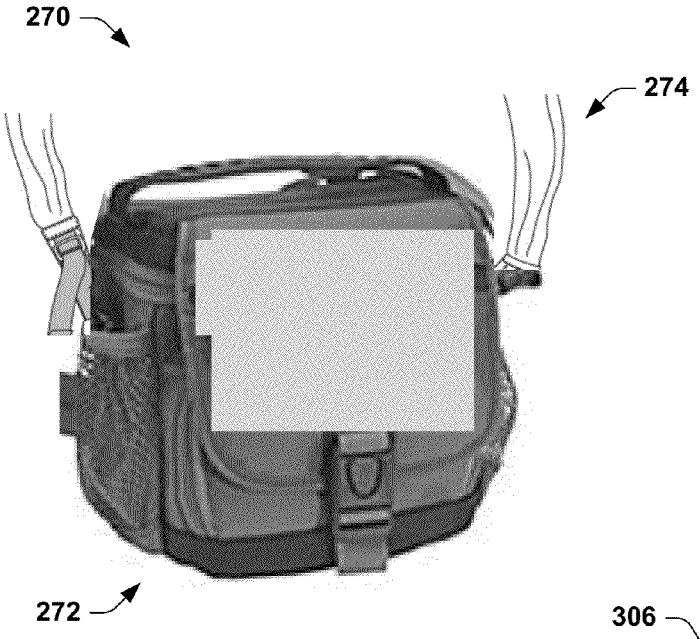
FIG. 9 is an isometric view of a containment member in accordance with yet another embodiment of the present disclosure.

It will be appreciated that straps in accordance with the teachings of the present disclosure may be used in association with a variety of different containment members and carrying assembly configurations (e.g. shoulder bags, totes, carrying cases, diaper bags, camera bags, etc.) and also for comfortably carrying or supporting devices (e.g. instruments, cameras, etc.). For example, FIGS. 7 through 9 show various alternate embodiments of containment members that may be used with straps (partially shown) in accordance with the teachings of the present disclosure. In FIG. 7, a carrying assembly 250 includes a tote or handbag-style containment member 252 coupled to a strap 254 (partially visible) in accordance with the teachings of the present disclosure. Similarly, FIG. 8 shows a carrying assembly 260 having a duffle-style containment member 262 coupled to a strap 264 (partially visible) in accordance with the teachings of the present disclosure, and FIG. 9 shows a carrying assembly 270 having a camera-bag-style containment member 272 coupled to a strap 274 (partially visible) in accordance with the teachings of the present disclosure. Of course, in alternate embodiments, any suitable containment member configurations may be employed, or any suitable instruments or devices may be supported or carried.

Figure 10:
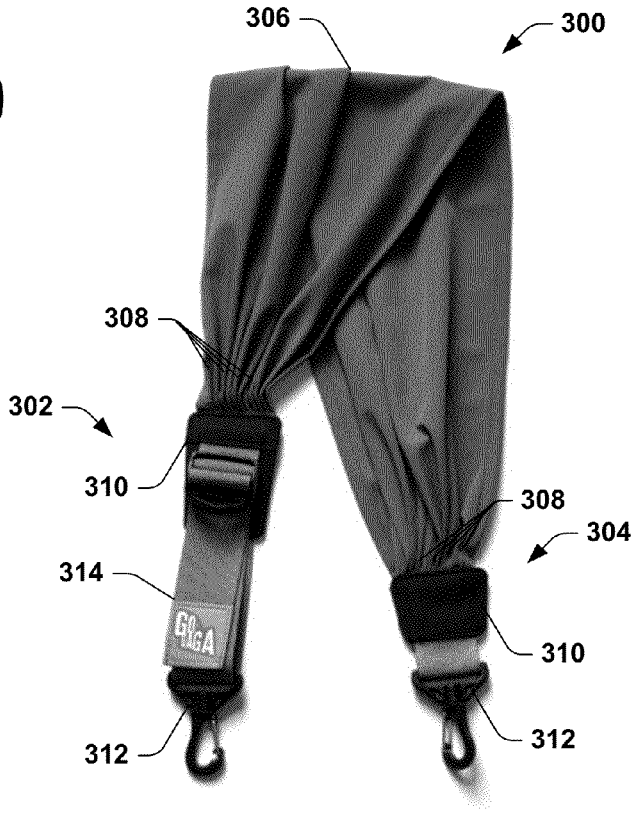
FIG. 10 is an elevational view of a strap in accordance with another embodiment of the present disclosure.

It will also be appreciated that alternate embodiments of straps in accordance with the teachings of the present disclosure may be conceived. For example, FIG. 10 is an elevational view of an expandable strap 300 in accordance with another embodiment of the present disclosure. In this embodiment, the strap 300 includes first and second end portions 302, 304, and an expandable, relatively wider intermediate portion 306 disposed between the first and second end portions 302, 304. A plurality of folds (or baffles) 308 are formed at the ends of the intermediate portion 306 proximate the first and second end portions 302, 304, and gussets 310 are coupled to the intermediate portion 306 proximate the plurality of folds 308 at each of the first and second end portions 302, 304.

In this embodiment, each of the first and second end portions 302, 304 includes a clip device 312 configured to couple the strap 300 to any suitable containment member. As shown in FIG. 10, in some embodiments, at least one of the first and second end portions 302, 304 (e.g. first end portion 302) includes an adjustment mechanism 314 that enables an overall length of the strap 300 to be adjusted.

The intermediate portion 306 of the strap 300 may be formed of a flexible material that enables the intermediate portion 306 to be condensed into a relatively smaller configuration (e.g. by a cinch member, not shown). Alternately, the flexible intermediate portion 306 may be expanded into a fully-deployed position having a width $w_{int}$. Furthermore, as described more fully above, the intermediate portion 306 may have a width $w_{int}$ that is several times wider than that of a width $w_{end}$ of at least one of the first and second end portions 302, 304. For example, in some embodiments, the width $w_{int}$ of the intermediate portion 306 may be between approximately twice and approximately ten times the width $w_{end}$ of at least one of the first and second end portions 302, 304. In other embodiments, the width $w_{int}$ of the intermediate portion 306 may be within a range of approximately four to approximately six times the width $w_{end}$ of at least one of the first and second end portions 302, 304. In further embodiments, the width $w_{int}$ of the intermediate portion 306 may be great than approximately ten times the width $w_{end}$ of at least one of the first and second end portions 302, 304.

Similarly, in some embodiments, the strap 300 may be a stretchable strap, and may be fabricated from (or fabricated to include) a stretchable material. As described more fully above, in some embodiments, the strap 300 may be fabricated using one or more stretchable materials, including an elastomeric material, a polyester material, a polyethylene material, a polyurethane material, a polyamide material (e.g. nylon), a "spandex" (or elastane) material (e.g. Lycra®), or any suitable combinations or blends of such materials. More particularly, in a presently-preferred embodiment, the intermediate portion 306 of the strap 110 is formed of a blend of nylon (approximately 91%) and Lycra® (approximately 9%), although a variety of blends having other relative percentages of nylon and spandex, or having materials other than nylon and spandex, may be employed.

Figure 11:
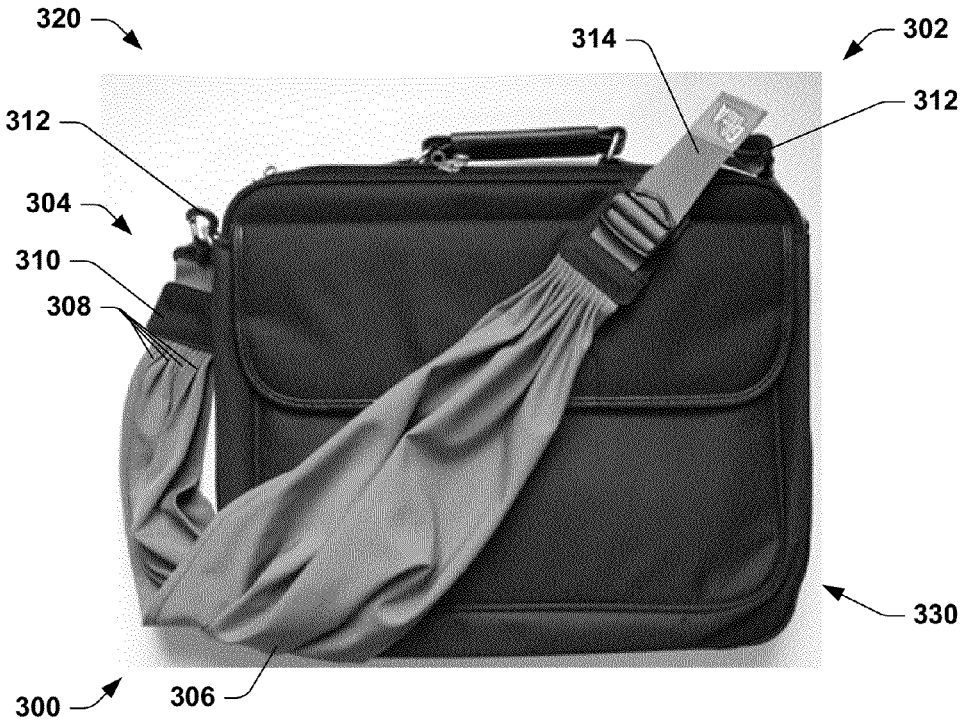
FIG. 11 is an elevational view of the strap of FIG. 10 coupled with a containment member in accordance with yet another embodiment of the present disclosure.

The strap 300 of FIG. 10 may provide the above-noted advantages of improved comfort and satisfaction, and may also provide improved versatility. More specifically, because the strap 300 includes the clip devices 312 coupled to each of the first and second end portions 302, 304, the strap 300 may be coupled to any suitable containment members for use in a wide variety of containment assemblies. For example, FIG. 11 is an elevational view of a carrying assembly 320 in accordance with yet another embodiment of the present disclosure. In this embodiment, the carrying assembly 320 includes the expandable strap 300 of FIG. 10 coupled with a containment member 330. In this embodiment, the containment member 330 comprises a laptop case. Of course, in alternate embodiments, any suitable type of containment member (e.g. diaper bag, tote bag, duffle bag, camera bag, etc.) may be employed.

Figure 12:
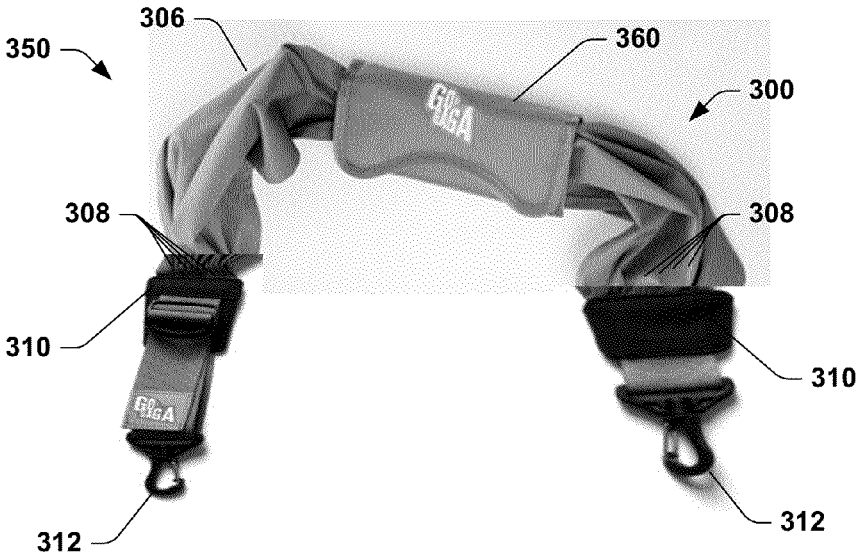
FIG. 12 is an elevational view of the strap of FIG. 10 coupled with a cinching member in accordance with another embodiment of the present disclosure.

FIG. 12 is an elevational view of a strap assembly 350 in accordance with another embodiment of the present disclosure. In this embodiment, the expandable strap 300 of FIG. 10 is coupled with a cinch member 360 that is slideably moveable along a length of the strap 300. More specifically, the cinch member 360 may be positioned proximate in an approximately central portion of the intermediate portion 306 (FIG. 12), condensing the intermediate portion 306 into a relatively small cross-sectional area. Alternately, the cinch member 360 may be slideably positioned proximate an end portion of the strap 300, enabling the intermediate portion 306 of the strap 300 to be deployed in a fully expanded position over the shoulder of the wearer. Finally, the cinch member 360 may be positioned at any other position along the strap 300 such that the intermediate portion 306 may be deployed in a partially or fully expanded position as desired by the wearer.

Figure 13:
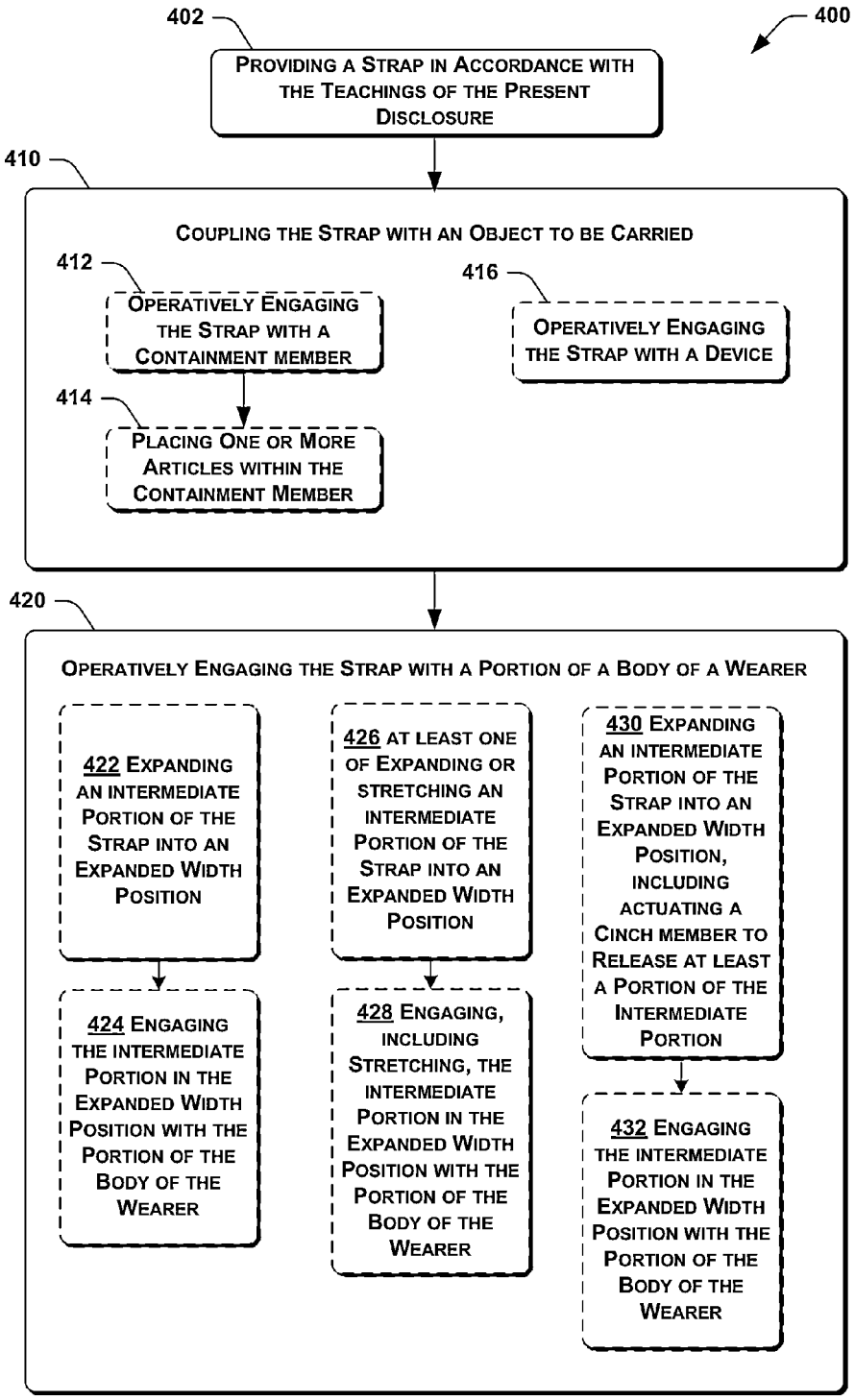
FIG. 13 is a flowchart showing a method of operating a carrying assembly in accordance with another embodiment of the present disclosure.

In addition to novel teaching ergonomic straps and carrying assemblies employing such straps, the present disclosure also teaches methods of operating carrying assemblies. For example, FIG. 13 is a flowchart showing a method 400 of operating a carrying assembly in accordance with another embodiment of the present disclosure. For simplicity, the method 400 will be described with reference to the exemplary embodiments of carrying assemblies described above with reference to FIGS. 1-12. The exemplary method is illustrated as a collection of blocks in a logical flow graph, which represents a sequence of operations. It will be appreciated, however, that the method 400 shown in FIG. 13 is one of many possible implementations in accordance with the teachings of the present disclosure. For example, in alternate implementations, certain acts need not be performed in the order described, and may be modified, and/or may be omitted entirely, depending on the circumstances. Moreover, in various implementations, the acts described may be implemented by a wearer, manufacturer, seller, or distributer of a carrying assembly, or any other suitable party, or by any suitable combinations of such persons or entities.

In the embodiment shown in FIG. 13, the method 400 includes providing a strap in accordance with the teachings of the present disclosure at 402. More specifically, in some embodiments, the providing of the strap at 402 may include providing a strap having an expandable/contractible intermediate portion disposed between first and second end portions, the intermediate portion having an expanded width $w_{int}$ that is several times wider than a nominal width $w_{end}$ of at least one of the first and second end portions, and wherein the intermediate portion is sufficiently flexible to be actuated between a condensed (or contracted) position (e.g. by a cinch member) such that a condensed width $w_{int}$ of the intermediate portion is substantially reduced in comparison with the expanded width $w_{int}$ of the intermediate portion.

As noted above, in various embodiments, the expanded width $w_{int}$ of the intermediate portion may be between approximately twice and approximately ten times the width $w_{end}$ of at least one of the first and second end portions. In other embodiments, the expanded width $w_{int}$ of the intermediate portion may be within a range of approximately four to approximately six times the width $w_{end}$ of at least one of the first and second end portions, and in further embodiments, the expanded width $w_{int}$ of the intermediate portion may be great than approximately ten times the width $w_{end}$ of at least one of the first and second end portions.

In some embodiments, the providing of the strap at 402 may include providing a strap having a cinch member slideably disposed thereon. In such embodiments, the cinch member may be configured to actuate the intermediate portion of the strap between an expanded position and a contracted position as the cinch member is slideably moved along a length of the strap from a first position proximate an end portion of the strap, and a second position spaced apart from the end portion of the strap (e.g. to an approximately central location along the strap).

Similarly, in some embodiments, the providing of the strap at 402 may include providing a stretchable strap fabricated from (or fabricated to include) a stretchable material (e.g. a stretchable polymeric material, an elastomeric material, an elastomeric polyester material, an elastic polyethylene material, a spandex (or elastane) material, etc.). Again, as described more fully above, in some embodiments, the providing of the strap at 402 may include providing a stretchable strap fabricated from (or fabricated to include) one or more stretchable materials, including an elastomeric material, a polyester material, a polyethylene material, a polyurethane material, a polyamide material (e.g. nylon), a "spandex" (or elastane) material (e.g. Lycra®), or any suitable combinations or blends of such materials.

With continued reference to FIG. 13, the method 400 may include coupling the strap with an object to be carried at 410. For example, in some implementations, coupling the strap with an object to be carried (at 410) may include operatively engaging the strap with a containment member at 412, and placing one or articles within the containment member at 414. Alternately, in some implementations, coupling the strap with an object to be carried (at 410) may include operatively engaging the strap with a device at 416.

At 420, the method 400 includes operatively engaging the strap with a portion of a body of a wearer. More specifically, in some embodiments, the strap may be operatively engaged (at 408) with top and lateral (side) surfaces of a shoulder of the wearer. As further shown in FIG. 13, in some embodiments, the operatively engaging the strap with a portion of a body of a wearer at 420 may include expanding an intermediate portion of the strap into an expanded width position at 422, and engaging the intermediate portion in the expanded width position with the portion of the body of the wearer (e.g. top and lateral shoulder surfaces) at 424.

Similarly, in further embodiments, the operatively engaging the strap with a portion of a body of a wearer at 420 may include at least one of expanding or stretching an intermediate portion of the strap into an expanded width position at 426, and engaging, including stretching, the intermediate portion in the expanded width position with the portion of the body of the wearer (e.g. top and lateral shoulder surfaces) at 428. In still other embodiments, the operatively engaging the strap with a portion of a body of a wearer at 420 may include expanding an intermediate portion of the strap into an expanded width position, including actuating a cinch member to release at least a portion of the intermediate portion at 430, and engaging the intermediate portion in the expanded width position with the portion of the body of the wearer (e.g. top and lateral shoulder surfaces) at 432. Of course, one or more of the above-recited actions may be variously combined with one or more other actions to achieve still further embodiments of methods in accordance with the teachings of the present disclosure.

The detailed descriptions of the above embodiments are not exhaustive descriptions of all embodiments contemplated by the inventors to be within the scope of the invention. Indeed, persons skilled in the art will recognize that certain elements of the above-described embodiments may variously be combined or eliminated to create further embodiments, and such further embodiments fall within the scope and teachings of the invention. It will also be apparent to those of ordinary skill in the art that the above-described embodiments may be combined in whole or in part to create additional embodiments within the scope and teachings of the present disclosure. Accordingly, the scope of the invention should be determined from the following claims.

What is claimed is:

1. An assembly, comprising:

an elongated strap member having a first end portion, a second end portion, and an intermediate portion coupled to and disposed between the first and second end portions, wherein the intermediate portion has a width that is largest at a mid-portion of its length and tapers as it extends to the end portions, the intermediate portion including a flexible material that is configured to be expanded and conform to a top surface and a lateral surface of a shoulder of the wearer when expanded and to condense into a condensed position wherein the intermediate portion has a width that is substantially smaller than the expanded width, said intermediate portion forming a relatively planar, unitary surface over the entire intermediate portion when expanded; and said elongated strap member including a discrete cinch member that encircles the entire width of the intermediate portion and is not secured to any portion of the elongated strap member, said cinch member being slideably moveable along the elongated strap member and moveable between a release position proximate at least one of the first or second end portions such that the cinch member does not restrict the intermediate portion and allows the mid-portion of the intermediate portion to be fully expanded, and a constrained position spaced apart from the first and second end portions such that the cinch member surrounds the mid-portion of the intermediate portion and constrains the mid-portion into the condensed position where its width is substantially smaller than when fully expanded.

2. The assembly of claim 1, wherein the first and second end portions have approximately equal widths, and wherein the width of the intermediate portion when expanded is at least approximately twice the width of the end portions.

3. The assembly of claim 1, comprising three or more longitudinally-extending folds extending across an entire length of the intermediate portion such that the intermediate portion is foldable in a substantially pleated configuration;

wherein the three or more longitudinally-extending folds taper the elongated strap member from an expanded width at the midpoint to an end portion width that is substantially smaller than the expanded width.

4. The assembly of claim 3, wherein the three or more longitudinally-extending folds divide the intermediate portion into longitudinally-extending segments having approximately equal widths.

5. The assembly of claim 3, wherein the three or more longitudinally-extending folds of the intermediate portion are folded such that the intermediate portion has a pleated cross-sectional shape where the intermediate portion meets at least one of the first or second end portions.

6. The assembly of claim 4, wherein the three or more longitudinally-extending folds of the intermediate portion divide the intermediate portion into longitudinally-extending segments, each longitudinally-extending segment having a width that is approximately equal to that of a neighboring longitudinally-extending segment.

7. The assembly of claim 1, wherein the intermediate portion includes a stretchable material that exhibits one or more stretchability characteristics of an elastomeric material.

8. The assembly of claim 7, wherein the stretchable material includes at least one of an elastomeric material, a polyester material, a polyethylene material, a polyurethane material, a polyamide material, a spandex material, or an elastane material.

9. The assembly of claim 7, wherein the stretchable material comprises a nylon/spandex blend having relative percentages within a range of approximately 80-99% nylon and approximately 20-1% spandex.

10. The assembly of claim 1, wherein the cinch member is configured to constrain the intermediate portion such that the condensed width is approximately equal to the width of the end portions.

11. The assembly of claim 1, further comprising at least one of a containment member or an object operatively coupled to the first and second end portions of the elongated strap member.

12. The assembly of claim 11, wherein the containment member comprises at least one of a shoulder bag, a tote, a handbag-style bag, a carrying case, a diaper bag, a duffle, a camera bag, or a laptop case, and wherein the object includes at least one of an instrument, a camera, or a device.

13. The assembly of claim 1 wherein the cinch member comprises a sleeve-shaped body that surrounds a slide passage configured to slideably receive the strap.

14. The assembly of claim 1 wherein said cinch member is configured to removably encircle said elongated strap member.

* * * * *

UNITED STATES PATENT AND TRADEMARK OFFICE

CERTIFICATE OF CORRECTION

PATENT NO. : 8,998,045 B2
APPLICATION NO. : 12/598838
DATED : April 7, 2015
INVENTOR(S) : Jill Cartwright It is certified that error appears in the above-identified patent and that said Letters Patent is hereby corrected as shown below:

Title Page,

The following information was in advertently omitted from the Letters Patent:

(22) PCT Filed: September 2, 2008

(86) PCT No.: PCT/US2008/075017

§ 371 (e)(1),
(2), (4) Date: November 4, 2009

(87) PCT Pub No.: WO 2009/029932

PCT Pub Date: March 5, 2009

Related U.S. Application Data

(60) Provisional Application No.: 60/969,643, filed on September 2, 2007

Signed and Sealed this
First Day of December, 2015

Michelle K. Lee

Michelle K. Lee
*Director of the United States Patent and Trademark Office*